US012584693B2

(12) United States Patent
Miwa et al.

(10) Patent No.: US 12,584,693 B2
(45) Date of Patent: Mar. 24, 2026

(54) MICROCHANNEL HEAT EXCHANGER

(71) Applicant: KOBE STEEL, LTD., Kobe (JP)

(72) Inventors: Yasutake Miwa, Takasago (JP); Yutaka Yagi, Takasago (JP); Tatsuo Nishihara, Takasago (JP); Kenichiro Mitsuhashi, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 56 days.

(21) Appl. No.: 18/401,273

(22) Filed: Dec. 29, 2023

(65) Prior Publication Data

US 2024/0240866 A1 Jul. 18, 2024

(30) Foreign Application Priority Data

Jan. 12, 2023 (JP) ..... 2023-003368

(51) Int. Cl.
*F28F 9/02* (2006.01)
*F28D 1/053* (2006.01)

(52) U.S. Cl.
CPC ..... *F28D 1/05391* (2013.01)

(58) Field of Classification Search
CPC ..... F28D 1/05391
USPC ..... 165/173
See application file for complete search history.

(56) References Cited

U.S. PATENT DOCUMENTS

2017/0328644 A1 11/2017 Takahashi
2019/0086155 A1 3/2019 Fujita et al.

FOREIGN PATENT DOCUMENTS

| | | | | |
|---|---|---|---|---|
| CA | 2965722 C | * | 9/2019 | |
| JP | 2015-105760 A | | 6/2015 | |
| JP | 5749786 B2 | | 7/2015 | |
| JP | 2017150810 A | * | 8/2017 | |
| KR | 10-2020-0034316 A | | 3/2020 | |
| WO | WO-2014122890 A1 | * | 8/2014 | ..... F25B 39/02 |
| WO | WO-2015016076 A1 | * | 2/2015 | ..... F28D 9/0093 |

OTHER PUBLICATIONS

The extended European search report issued by the European Patent Office on Jun. 14, 2024, which corresponds to European Patent Application No. 23220462.8.

* cited by examiner

*Primary Examiner* — Davis D Hwu
(74) *Attorney, Agent, or Firm* — Studebaker Brackett PLLC

(57) ABSTRACT

A microchannel heat exchanger is a heat exchanger for cooling hydrogen gas with a cooling medium, and includes a cooling side layer formed with a plurality of medium flow paths for flowing the cooling medium, and a high temperature side layer formed with a plurality of hydrogen flow paths for flowing the hydrogen gas and a first introduction port for flowing the hydrogen gas into the plurality of hydrogen flow paths. The first introduction port has a circular shape or an elliptical shape. An inflow end of each of the plurality of hydrogen flow paths is connected to a peripheral surface of the first introduction port. The hydrogen flow path extends from the first introduction port to the first lead out port without branching.

7 Claims, 7 Drawing Sheets

MICROCHANNEL HEAT EXCHANGER

FIELD OF INVENTION

The present invention relates to a microchannel heat exchanger.

BACKGROUND ART

In recent years, in consideration of the environment, use of hydrogen for power generation and as fuel for an automobile, and the like is considered, and demand for hydrogen is increasing. Further, a hydrogen station for filling a tank of an automobile or the like with hydrogen gas is also known. On the other hand, as disclosed in JP 2017-180984 A and JP 5847913 B1, a microchannel heat exchanger, which is not used for cooling hydrogen gas, is also known. The microchannel heat exchanger includes a first heat exchanger plate in which a large number of groove-shaped first flow paths through which a first fluid is circulated are formed, and a second heat exchanger plate in which a large number of groove-shaped second flow paths through which a second fluid is circulated are formed, and these heat exchanger plates are joined in a state of being placed on each other.

In the microchannel heat exchanger disclosed in JP 2017-180984 A, as illustrated in FIG. 5, an introduction path 82 for introducing one fluid into a first flow path 81 is provided so as to penetrate a first heat exchanger plate 83 and a second heat exchanger plate 84. Then, as illustrated in FIG. 6, one relay flow path 85 is connected to a peripheral surface of the introduction path 82, and a large number of the first flow paths 81 are connected to the relay flow path 85 so as to be branched from the relay flow path 85.

Similarly, in the microchannel heat exchanger disclosed in JP 5847913 B1, an introduction path is provided so as to penetrate the first heat exchanger plate and the second heat exchanger plate. However, in the heat exchanger disclosed in JP 5847913 B1, as illustrated in FIG. 7, a plurality of relay flow paths 85 are connected to a peripheral surface of an introduction path 82, and a large number of first flow paths 81 are connected to the relay flow paths 85 so as to be branched from the plurality of relay flow paths 85.

In the microchannel heat exchangers disclosed in JP 2017-180984 A and JP 5847913 B1, since a cross section of the introduction path 82 is circular, if one or the plurality of relay flow paths 85 are connected to a peripheral surface of the introduction path 82, generation of local thermal stress is reduced at the connection portion. That is, since the introduction path 82 has a circular cross section and no corner portion having a section shape or the like is formed on a peripheral surface of the introduction path 82, stress concentration hardly occurs in the introduction path 82. However, only the introduction path 82 having a circular cross section is insufficient for reducing stress concentration.

SUMMARY OF THE INVENTION

An object of the present invention is to reduce local and intensive generation of thermal stress in a layer having a plurality of flow paths through which a cooling medium or hydrogen gas flows in a microchannel heat exchanger.

A microchannel heat exchanger according to one aspect of the present invention is a microchannel heat exchanger for cooling hydrogen gas with a cooling medium. The microchannel heat exchanger includes a cooling side layer formed with a plurality of medium flow paths for flowing the cooling medium, and a high temperature side layer placed on the cooling side layer, the high temperature side layer being formed with a plurality of hydrogen flow paths for flowing the hydrogen gas and an introduction port for flowing the hydrogen gas into the plurality of hydrogen flow paths. The introduction port has a circular shape or an elliptical shape. An inflow end of each of the plurality of hydrogen flow paths is connected to a peripheral surface of the introduction port. The cooling side layer and the high temperature side layer include a heat exchange region in which the plurality of medium flow paths and the plurality of hydrogen flow paths overlap each other in a direction in which the cooling side layer and the high temperature side layer are placed on each other. The plurality of hydrogen flow paths extend from the inflow end to the heat exchange region without branching.

DETAILED DESCRIPTION

An embodiment of the present invention will hereinafter be described in detail with reference to the drawings.

A microchannel heat exchanger according to the present embodiment is to be used as a pre-cooler of a hydrogen station and is configured as a heat exchanger that cools hydrogen gas with a cooling medium. That is, since a tank of a fuel cell vehicle or the like is filled with hydrogen gas supplied from a hydrogen station at a high pressure (pressure of 10 MPa or more), a temperature of the hydrogen gas rises in the tank. For this reason, the hydrogen gas is cooled by a cooling medium in the pre-cooler before being supplied to the tank. Note that, as the cooling medium, brine, carbon dioxide, alternative CFCs, or the like can be used. However, the microchannel heat exchanger is not limited to one used as a pre-cooler of a hydrogen station as long as the microchannel heat exchanger is used as a heat exchanger for cooling hydrogen gas.

Figure 1:
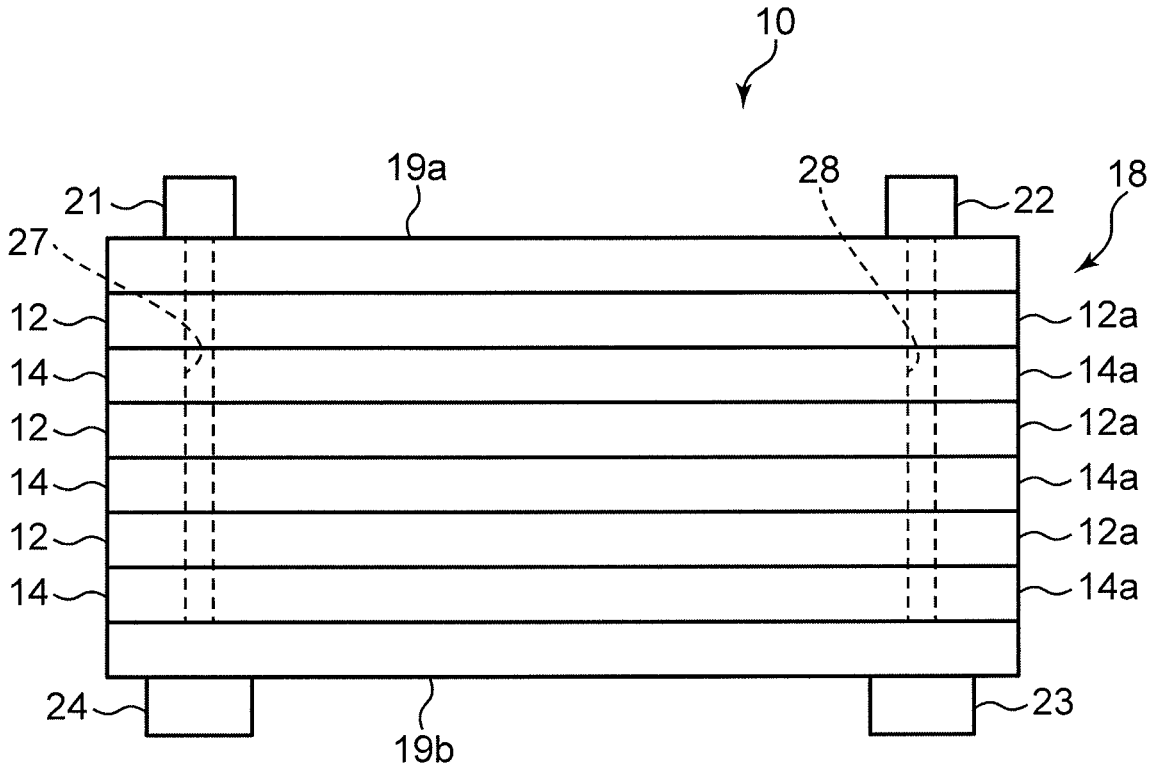
FIG. 1 is a side view of a microchannel heat exchanger according to an embodiment.

As illustrated in FIG. 1, a microchannel heat exchanger 10 includes a plurality of high temperature side layers 12 and a plurality of cooling side layers 14. The plurality of high temperature side layers 12 and the plurality of cooling side layers 14 are arranged in a stack in a thickness direction in a manner that the high temperature side layer 12 and the cooling side layer 14 are alternately arranged. FIG. 1 illustrates an example in which the plurality of high temperature side layers 12 and the plurality of cooling side layers 14 are laminated, but the present invention is not limited to this. For example, a microchannel heat exchanger 10 may include one high temperature side layer 12 and one cooling side layer 14 arranged in stack.

The high temperature side layer 12 and the cooling side layer 14 are respectively formed of metal plates 12*a* and 14*a* made from a material having high thermal conductivity. A plurality of the metal plates 12*a* and 14*a* placed on each other are, for example, diffusion bonded to each other to form a laminate (stack) 18 having a plurality of the high temperature side layers 12 and a plurality of the cooling side layers 14. Long and thin grooves are formed on one surface of each of the metal plates 12*a* and 14*a*. For this reason, as a plurality of the metal plates 12*a* and 14*a* are laminated, flow paths 33 and 34 including a microchannel are formed in the high temperature side layer 12 and the cooling side layer 14, respectively. End plates 19*a* and 19*b* are provided on both sides of the laminate 18 in a superposing direction (vertical direction in FIG. 1).

Note that the laminate 18 is not limited to a structure in which the high temperature side layer 12 and the cooling side layer 14 are bonded by diffusion bonding. In a case where the metal plates 12*a* and 14*a* are diffusion bonded to each other, a boundary between the high temperature side layer 12 and the cooling side layer 14 does not clearly appear, but in a case where another bonding method is used, a boundary between the layers 12 and 14 may appear.

The laminate 18 is provided with a first introduction header 21, a first lead out header 22, a second introduction header 23, and a second lead out header 24. The first introduction header 21 allows hydrogen gas from the outside of the laminate 18 to flow into the hydrogen flow path 33 described later. The first lead out header 22 allows hydrogen gas flowing through the hydrogen flow path 33 to flow out to the outside. The second introduction header 23 introduces a cooling medium from the outside of the laminate 18 into the medium flow path 34 described later. The second lead out header 24 leads out to the outside a cooling medium flowing through the medium flow path 34. FIG. 1 illustrates a configuration in which the first introduction header 21 and the first lead out header 22 are provided on one surface of the laminate 18. Alternatively, the first introduction header 21 and the first lead out header 22 may be provided on opposite surfaces of the laminate 18. The above similarly applies to the second introduction header 23 and the second lead out header 24.

A first introduction path 27 is connected to the first introduction header 21. The first introduction path 27 is a flow path for allowing hydrogen gas to flow from the outside of the laminate 18 (or the first introduction header 21) to each of the hydrogen flow paths 33 described later, and is formed so as to penetrate the high temperature side layers 12 and the cooling side layers 14. Note that an end portion of the first introduction path 27 on the opposite side to the first introduction header 21 is closed.

A first lead out path 28 is connected to the first lead out header 22. The first lead out path 28 is a flow path for leading out hydrogen gas flowing through each of the hydrogen flow paths 33 described later to the outside of laminate 18 (or the first lead out header 22), and is formed so as to penetrate the high temperature side layers 12 and the cooling side layers 14. Note that an end portion of the first lead out path 28 on the opposite side to the first lead out header 22 is closed.

A second introduction path 29 (see FIG. 4) is connected to the second introduction header 23. The second introduction path 29 is a flow path for allowing a cooling medium to flow from the outside of the laminate 18 (or the second introduction header 23) to each of the medium flow paths 34 described later, and is formed so as to penetrate the high temperature side layers 12 and the cooling side layers 14. Note that an end portion of the second introduction path 29 on the opposite side to the second introduction header 23 is closed.

A second lead out path 30 (see FIG. 4) is connected to the second lead out header 24. The second lead out path 30 is a flow path for leading out a cooling medium flowing through each of the medium flow paths 34 described later to the outside of the laminate 18 (or the second lead out header 24), and is formed so as to penetrate the high temperature side layers 12 and the cooling side layers 14. Note that an end portion of the second lead out path 30 on the opposite side to the second lead out header 24 is closed.

Figure 2:
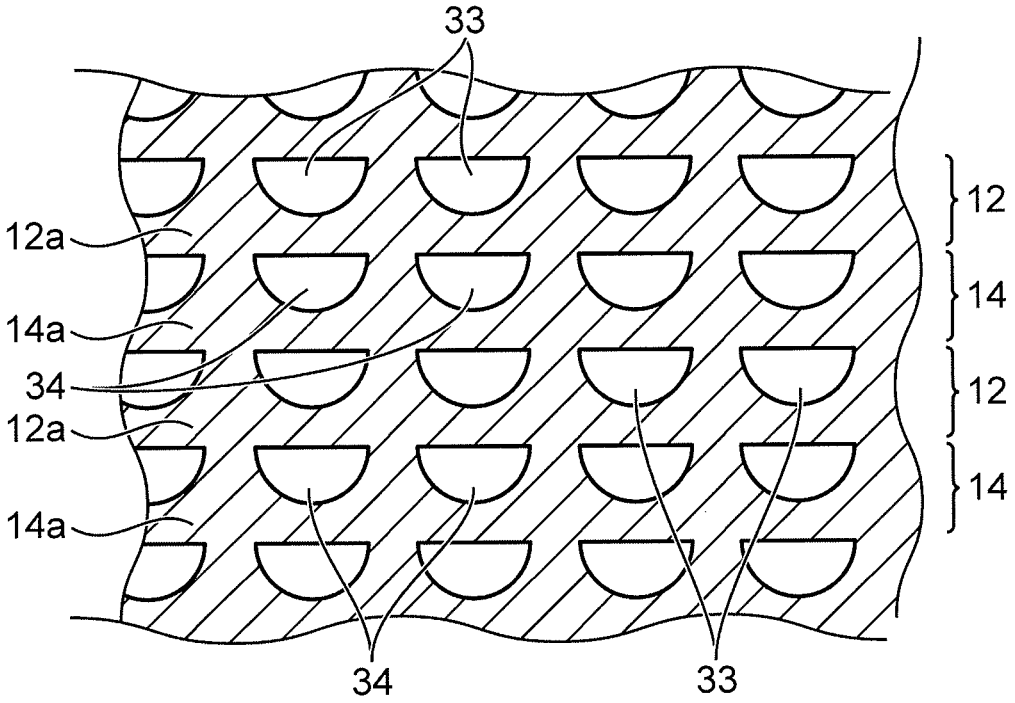
FIG. 2 is a partial cross-sectional view of a laminate in the microchannel heat exchanger.

As illustrated in FIG. 2, each of the high temperature side layers 12 is formed as a flat region including a plurality of the hydrogen flow paths 33, and each of the cooling side layers 14 is formed as a flat region including a plurality of the medium flow paths 34. A plurality of the hydrogen flow paths 33 are arranged so as to be aligned in one direction (lateral direction in FIG. 2) in the high temperature side layer 12, and a plurality of the medium flow paths 34 are arranged in the cooling side layer 14 so as to be aligned in the same direction as the direction in which the hydrogen flow paths 33 are arranged. That is, since the metal plates 12*a* and 14*a* having a plurality of grooves formed on one surface of the metal plates 12*a* and 14*a* are placed on one another and bonded, a plurality of the hydrogen flow paths 33 are aligned in one direction and a plurality of the medium flow paths 34 are aligned in one direction. A plurality of the hydrogen flow paths 33 and a plurality of the medium flow paths 34 are alternately arranged in a superposing direction (vertical direction in FIG. 2). That is, in a cross section of the laminate 18 illustrated in FIG. 2, a plurality of the hydrogen flow paths 33 and a plurality of the medium flow paths 34 extend in the same direction. However, a plurality of the hydrogen flow paths 33 and a plurality of the medium flow paths 34 are not necessarily formed so as to extend in the same direction at any place of the laminate 18. For example, a plurality of the hydrogen flow paths 33 and a plurality of the medium flow paths 34 may extend in the same direction at one place in the laminate 18, and a plurality of the hydrogen flow paths 33 and a plurality of the medium flow paths 34 may extend in different directions at another place in the laminate 18. Note that all of the hydrogen flow paths 33 and the medium flow paths 34 have a semicircular cross section.

Figure 3:
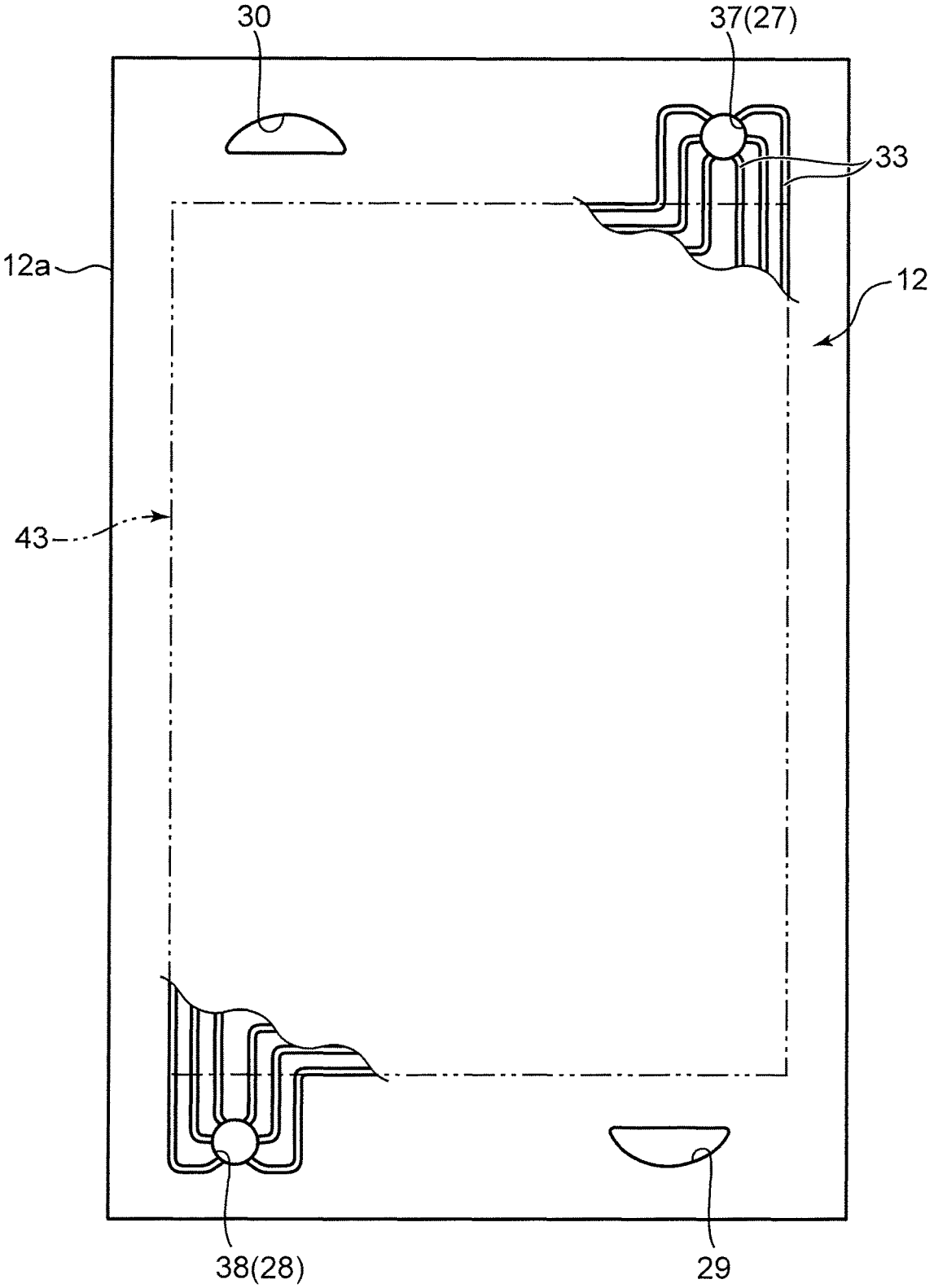
FIG. 3 is a top view of a metal plate constituting a high temperature side layer of the microchannel heat exchanger.

As illustrated in FIG. 3, the metal plate 12*a* forming the high temperature side layer 12 is formed in a rectangular shape in top view, and a plurality of the hydrogen flow paths 33 are formed on an upper surface of the metal plate 12*a*.

In the metal plate 12*a*, a first introduction port 37 and a first lead out port 38 are formed so as to penetrate the metal plate 12*a* in a thickness direction. The first introduction port 37 is a part of the first introduction path 27 penetrating the high temperature side layers 12 and the cooling side layers 14, the first introduction port 37 being a part of the first introduction path 27 located in the high temperature side layer 12 formed of the metal plate 12*a*. The first lead out port 38 is a part of the first lead out path 28 penetrating the high temperature side layers 12 and the cooling side layers 14, the first lead out port 38 being a part of the first lead out path 28 in the high temperature side layer 12 formed of the metal plate 12*a*.

The first introduction port 37 and the first lead out port 38 have circular or elliptical shape. One end (inflow end) of each of the hydrogen flow paths 33 is connected to a peripheral surface of the first introduction port 37. Specifically, inflow ends of the hydrogen flow paths 33 in one of the high temperature side layers 12 are connected to a peripheral surface of the first introduction port 37 at intervals in a circumferential direction of the first introduction port 37, and these connection portions are located over the entire circumference of the first introduction port 37. Here, "over the entire circumference" means that a plurality of connection portions exist at intervals over the entire circumference of the first introduction port 37. For this reason, a portion to which the hydrogen flow path 33 is not connected may exist on a part of the circumference of the first introduction port 37. Further, a plurality of connection portions do not need to be at equal intervals. That is, an interval between adjacent connection portions may be wider than an interval between other adjacent connection portions. It is sufficient that a width of an interval between any adjacent connection portions is ¼ (or ⅙ or ⅛) or less of a circumference of the first introduction port 37. A relationship between connection portions of a plurality of the hydrogen flow paths 33 to the first introduction port 37 is the same in any of the high temperature side layers 12.

The other end (outflow end) of each of the hydrogen flow paths 33 is connected to a peripheral surface of the first lead out port 38. Then, each of the hydrogen flow paths 33 extends from the first introduction port 37 to the first lead out port 38 without branching. Hydrogen gas in the first introduction path 27 is distributed to each of the hydrogen flow paths 33 in each of the high temperature side layers 12. Hydrogen gas flowing through each of the hydrogen flow paths 33 joins the first lead out path 28 (first lead out port 38) without being divided, and is sent to the outside of the microchannel heat exchanger 10 through the first lead out header 22.

Note that, since a temperature of hydrogen gas is close to a temperature of a cooling medium at an outflow end of the hydrogen flow path 33, the first lead out port 38 does not need to be circular or elliptical, and may be semicircular, for example. Further, connection portions of the hydrogen flow path 33 to the first lead out port 38 may be located at intervals over the entire circumference of the first lead out port 38, but is not necessarily required to be located over the entire circumference, and the connection portions may exist, for example, within a range of ⅔ of the circumference.

Figure 4:
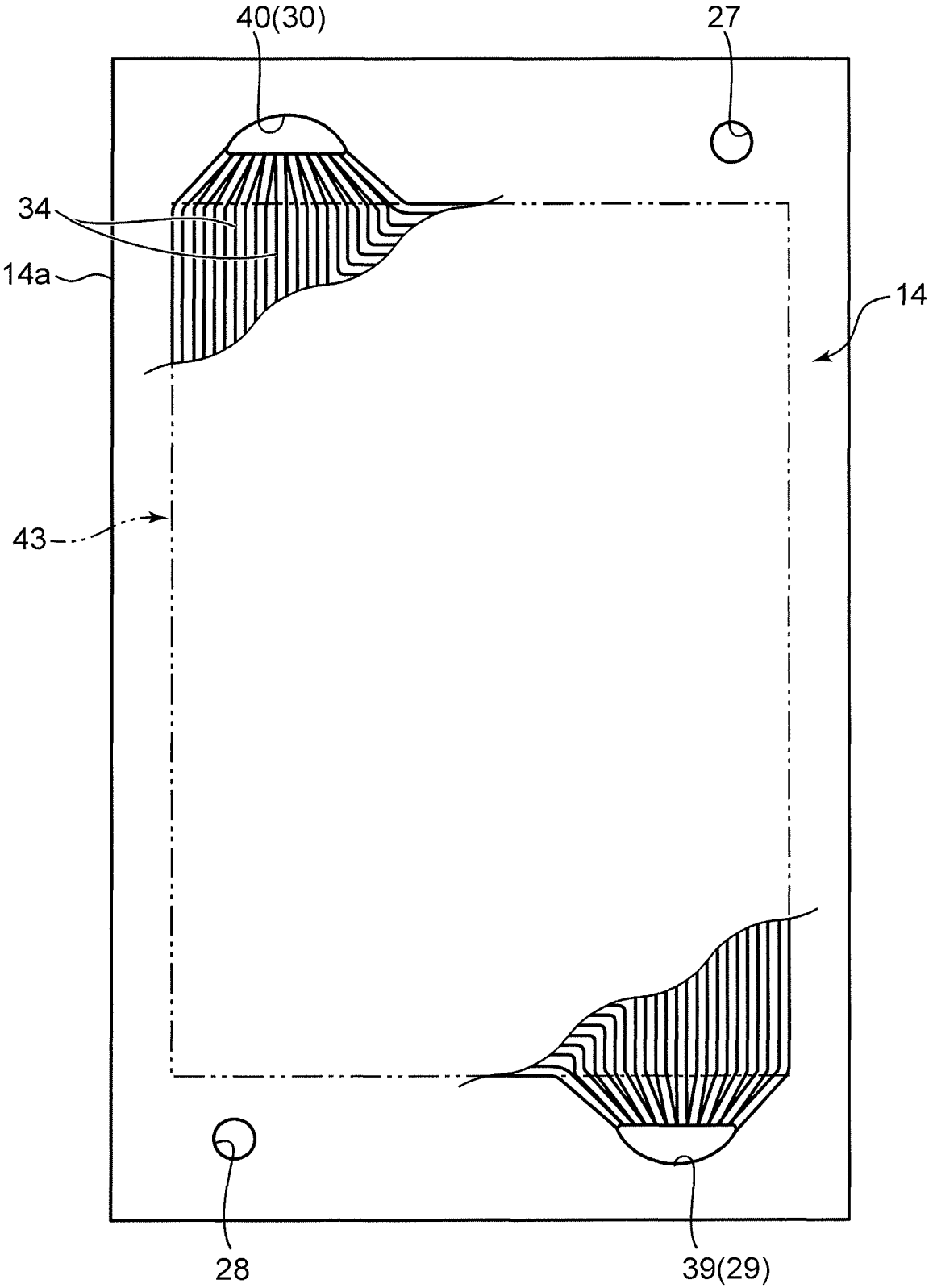
FIG. 4 is a top view of a metal plate constituting a cooling side layer of the microchannel heat exchanger.
Figure 5:
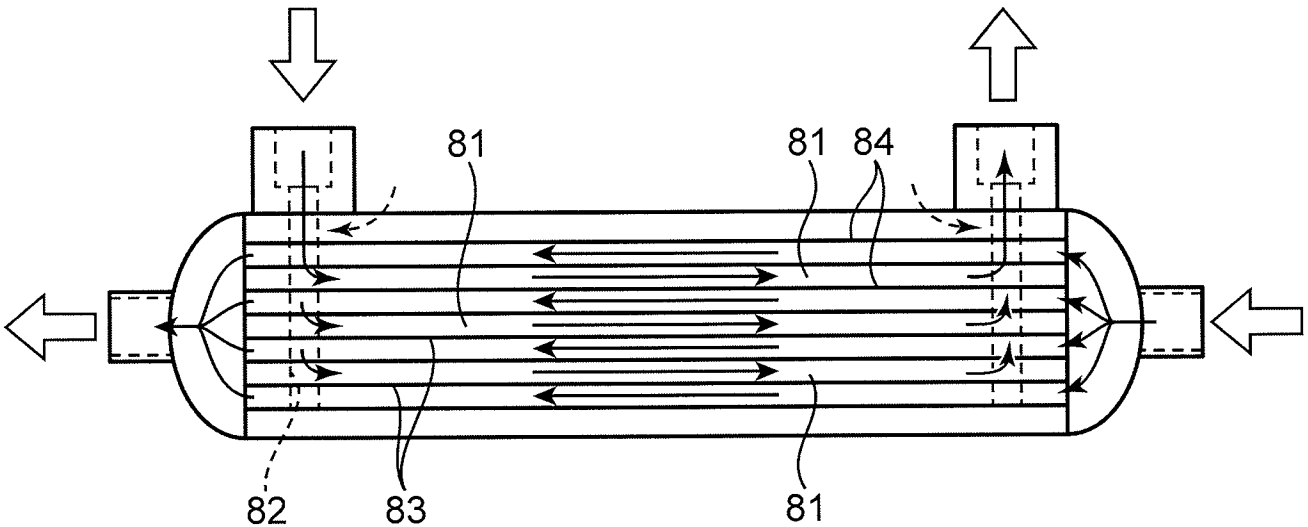
FIG. 5 is a side view of a conventional microchannel heat exchanger.
Figure 6:
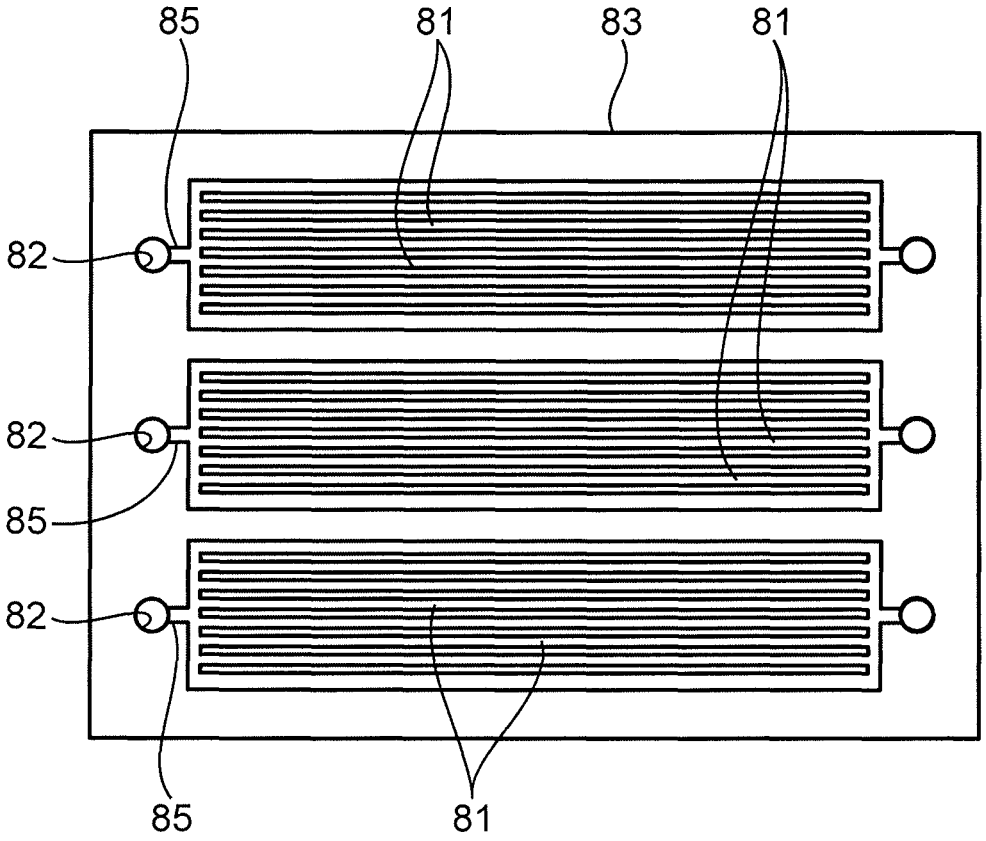
FIG. 6 is a top view of a first heat exchanger plate constituting a conventional microchannel heat exchanger.
Figure 7:
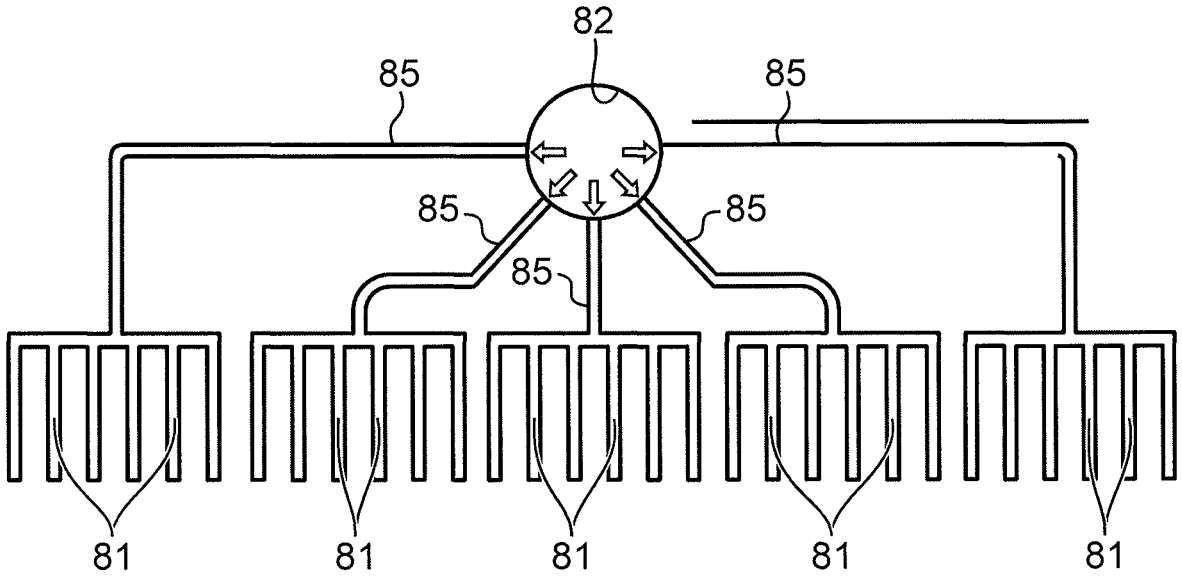
FIG. 7 is a top view of a first heat exchanger plate constituting a conventional microchannel heat exchanger.

As illustrated in FIG. 4, the metal plate 14*a* forming the cooling side layer 14 is formed in a rectangular shape in top view, and a plurality of the medium flow paths 34 are formed on an upper surface of the metal plate 14*a*. The number of the medium flow paths 34 is larger than the number of the hydrogen flow paths 33. For this reason, when a cooling medium flowing through the medium flow path 34 exchanges heat with hydrogen gas, a temperature of the cooling medium does not change much as compared with a temperature change of hydrogen gas. On the other hand, hydrogen gas flowing through the hydrogen flow path 33 greatly changes in temperature upon heat exchange with a cooling medium, and the temperature approaches a temperature of the cooling medium. That is, a temperature change amount of hydrogen gas in the hydrogen flow path 33 is larger than a temperature change amount of a cooling medium in the medium flow path 34.

A second introduction port (medium introduction port) 39 and a second lead out port (medium lead out port) 40 are formed in the metal plate 14*a* so as to penetrate the metal plate 14*a* in a thickness direction. The second introduction port 39 is a portion of the cooling side layer 14 formed of the metal plate 14*a* in the second introduction path 29 penetrating the high temperature side layers 12 and the cooling side layers 14. The second lead out port 40 is a portion of the cooling side layer 14 formed of the metal plate 14*a* in the second lead out path 30 penetrating the high temperature side layers 12 and the cooling side layers 14.

The second introduction port 39 and the second lead out port 40 have a semicircular shape having an area larger than those of the first introduction port 37 and the first lead out port 38. That is, a flow rate of a cooling medium introduced through the second introduction path 29 is larger than a flow rate of hydrogen gas introduced through the first introduction path 27. Note that a shape of the second introduction port 39 and the second lead out port 40 is not limited to a semicircular shape as long as a flow rate of a cooling medium can be secured, and may be, for example, a circular shape or an elliptical shape.

One end (introduction end) of each of the medium flow paths 34 is connected to a portion corresponding to a chord of a semicircle of a circumference of the second introduction port 39. The other end (lead out end) of each of the medium flow paths 34 is connected to a portion corresponding to a chord of a semicircle of a circumference of the second lead out port 40. Then, each of the medium flow paths 34 extends from the second introduction port 39 to the second lead out port 40. A cooling medium in the second introduction path 29 is divided into the medium flow paths 34 in each of the cooling side layers 14. A cooling medium flowing through each of the medium flow paths 34 joins the second lead out path 30 (second lead out port 40) without being divided, and is sent to the outside of the microchannel heat exchanger 10 through the second lead out header 24.

In the hydrogen flow path 33, a region overlapping the medium flow path 34 in a direction in which the high temperature side layer 12 and the cooling side layer 14 are arranged in a stack (superposing direction or vertical direction in FIG. 2) is a heat exchange region 43. That is, if hydrogen gas flows into the hydrogen flow path 33 from the first introduction port 37, the hydrogen gas hardly exchanges heat with a cooling medium until reaching the heat exchange region 43. Then, hydrogen gas exchanges heat with a cooling medium flowing through the medium flow path 34 while flowing through the hydrogen flow path 33 in the heat exchange region 43.

In the present embodiment, each of the hydrogen flow paths 33, which extends from the first introduction port 37 to the first lead out port 38 without branching, does not branch at least from the first introduction port 37 to the heat exchange region 43, and does not branch also in a first half portion having a relatively large temperature difference from a cooling medium also in the heat exchange region 43. Note that, in a second half of the heat exchange region 43 and after that, each of the hydrogen flow paths 33 may branch.

Hydrogen gas flows into the hydrogen flow path 33 at a temperature of, for example, 30° ° C. or more, and a cooling medium flows into the medium flow path 34 at a temperature of −30° C. or less. Hydrogen gas may circulate through the hydrogen flow path 33 in a very high pressure (pressure of 10 MPa or more) state. Then, when passing through the heat exchange region 43, hydrogen gas is cooled to a temperature of −30° ° C. or less. That is, a temperature of hydrogen gas changes from a positive temperature zone to a negative temperature zone while hydrogen gas flowing through the hydrogen flow path 33. On the other hand, a cooling medium has a temperature of −30° C. or less even when passing through the heat exchange region 43. That is, a cooling medium flows through the medium flow path 34 in a negative temperature zone. Therefore, a temperature change of hydrogen gas from the first introduction port 37 to the first lead out port 38 is larger than a temperature change of a cooling medium from the second introduction port 39 to the second lead out port 40.

As described above, in the present embodiment, when hydrogen gas is cooled by a cooling medium, thermal stress is generated in the high temperature side layer 12 or the cooling side layer 14 due to a temperature difference between the cooling medium and the hydrogen gas. Further, in the present embodiment, the microchannel heat exchanger 10 is for a hydrogen station, and the inside of the heat exchanger 10 is exposed to a high pressure because extremely high pressure hydrogen gas is circulated. For this reason, stress generated in the microchannel heat exchanger 10 further increases. However, since the first introduction port 37 for allowing hydrogen gas to flow in has a circular or elliptical cross section, stress such as the thermal stress is suppressed to be locally concentrated in a portion where a plurality of the hydrogen flow paths 33 are connected to a peripheral surface of the first introduction port 37. That is, in a case where the first introduction port 37 has semicircular shape, stress may be locally generated at a corner portion of a semicircle. However, since the first introduction port 37 has circular or elliptical shape, stress concentration hardly occurs in the vicinity of a peripheral surface. Further, since the hydrogen flow path 33 is not branched in a range in which hydrogen gas before being cooled by a cooling medium flows, it is also possible to suppressed to occur local concentration of thermal stress caused by the temperature difference and stress caused by internal pressure in the vicinity of the hydrogen flow path 33. That is, in a portion where hydrogen gas before being cooled by a cooling medium flows in the hydrogen flow path 33, not only stress caused by internal pressure of high pressure is generated, but also thermal stress caused by a large temperature difference between a cooling medium and hydrogen gas is likely to become high. For this reason, if a branch is provided at this portion, stress tends to concentrate at the branch portion. However, in this portion, since a branch point of the hydrogen flow path 33 is not provided, stress is prevented from being locally concentrated. Further, this contributes to stable supply of hydrogen gas.

Further, in the present embodiment, since inflow ends of the hydrogen flow paths 33 are located at intervals over the entire circumference of the first introduction port 37, a large number of the hydrogen flow paths 33 can be connected to the first introduction port 37. That is, when the number of the hydrogen flow paths 33 is increased, a flow rate of hydrogen gas can be increased, and accordingly, thermal stress caused by a temperature difference between a cooling medium and hydrogen gas is likely to be generated. However, since local generation of thermal stress is suppressed as described above, it is possible to increase a flow rate of hydrogen gas while suppressing an adverse effect due to stress concentration.

Further, in the present embodiment, since the hydrogen flow path 33 is configured not to branch from the first introduction port 37 to the first lead out port 38, it is possible to prevent local generation of stress over the entire hydrogen flow path 33. Therefore, in a case where the microchannel heat exchanger 10 is used for a purpose where thermal stress or stress caused by internal pressure is likely to occur, it is possible to reduce influence on durability of the high temperature side layer 12 or the cooling side layer 14.

Further, the microchannel heat exchanger 10 according to the present embodiment is used as a pre-cooler of a hydrogen station. In a hydrogen station, supply and stop of hydrogen gas are repeated depending on presence or absence of a fuel cell vehicle or the like to be charged with hydrogen gas. For this reason, in a pre-cooler, hydrogen gas is repeatedly cooled and stopped. Furthermore, since hydrogen gas having an extremely high pressure (pressure of 10 MPa or more) circulates through a pre-cooler, local generation and release of extremely large stress are repeated due to internal pressure fluctuation and thermal change. Therefore, durability of the microchannel heat exchanger 10 may be affected. However, since the microchannel heat exchanger 10 used as a pre-cooler is configured to suppress stress to be locally concentrated, it is possible to reduce influence on deterioration of durability of the microchannel heat exchanger 10.

It should be understood that the embodiment disclosed herein is illustrative in all respects and is not restrictive. The present invention is not limited to the above embodiment, and various modifications, improvements, and the like can be made without departing from the gist of the present invention. For example, in the above embodiment, the second introduction port 39 and the second lead out port 40 are formed as a part of the second introduction path 29 or the second lead out path 30 penetrating the high temperature side layers 12 and the cooling side layers 14, but the present embodiment is not limited to this. For example, the second introduction port 39 and the second lead out port 40 may be opened to an outer peripheral surface (side surface) of the metal plates 12*a* or 14*a* forming the high temperature side layer 12 or the cooling side layer 14, instead of penetrating the metal plate 14*a* in a thickness direction. That is, one end (introduction end) of the medium flow path 34 may be opened to an outer peripheral surface (side surface) of the metal plate 14*a* as the second introduction port 39. The other end (leading end) of the medium flow path 34 may be opened to an outer peripheral surface (side surface) of the metal plate 14*a* as the second lead out port 40. In this case, the second introduction header 23 is provided on a side surface of the laminate 18 where the second introduction port 39 is opened, and the second lead out header 24 is provided on a side surface of the laminate 18 where the second lead out port 40 is opened. In this case, the second introduction path 29 and the second lead out path 30 are omitted.

Further, the microchannel heat exchanger 10 may be directly connected to a device or the like at a preceding stage or a subsequent stage without a pipe or the like. In this case, the introduction headers 21 and 23 and the lead out headers 22 and 24 are omitted.

Here, the embodiment will be outlined.

(1) A microchannel heat exchanger according to the embodiment is a microchannel heat exchanger for cooling hydrogen gas with a cooling medium. The microchannel heat exchanger includes a cooling side layer formed with a plurality of medium flow paths for flowing the cooling medium, and a high temperature side layer placed on the cooling side layer, the high temperature side layer being formed with a plurality of hydrogen flow paths for flowing the hydrogen gas and an introduction port for flowing the hydrogen gas into the plurality of hydrogen flow paths. The introduction port has a circular shape or an elliptical shape. An inflow end of each of the plurality of hydrogen flow paths is connected to a peripheral surface of the introduction port. The cooling side layer and the high temperature side layer include a heat exchange region in which the plurality of medium flow paths and the plurality of hydrogen flow paths overlap each other in a direction in which the cooling side layer and the high temperature side layer are placed on each other. The plurality of hydrogen flow paths extend from the inflow end to the heat exchange region without branching.

In the microchannel heat exchanger, when hydrogen gas is cooled by a cooling medium, thermal stress is generated in the high temperature side layer or the cooling side layer due to a temperature difference between the cooling medium and the hydrogen gas. Further, for example, in a case where high pressure hydrogen gas is circulated as in a case where hydrogen gas for a hydrogen station is supplied, the inside of a heat exchanger is exposed to high pressure, and stress generated in the microchannel heat exchanger becomes larger. However, since the introduction port for allowing hydrogen gas to flow in has a circular or elliptical cross section, stress such as the thermal stress is prevented from being locally concentrated in a portion where the plurality of hydrogen flow paths are connected to a peripheral surface of the introduction port. That is, in a case where the introduction port is semicircular, stress due to influence of a temperature difference (in a case where high pressure hydrogen gas is circulated, influence of internal pressure is also added) may be locally generated at a semicircular corner portion. However, since the introduction port is circular or elliptical, stress concentration hardly occurs. Further, since the hydrogen flow path does not branch in a range in which hydrogen gas before being cooled by a cooling medium flows, it is also possible to prevent occurrence of local concentration of thermal stress (in a case where high pressure hydrogen gas is circulated, stress caused by internal pressure is added) due to the temperature difference. That is, in a portion through which hydrogen gas before being cooled by a cooling medium flows in the hydrogen flow path, thermal stress is likely to become large due to a large temperature difference between the cooling medium and the hydrogen gas, and thus, when a branch is provided in this portion, thermal stress is likely to be concentrated in the branch portion. However, in this portion, since no branch point of the hydrogen flow path is provided, occurrence of local concentration of thermal stress is prevented. Further, in a case where high pressure hydrogen gas is circulated, stress caused by internal pressure may be generated. However, even in this case, since a branch point of the hydrogen flow path is not provided, occurrence of local concentration of stress caused by internal pressure is prevented.

(2) The inflow ends of the plurality of hydrogen flow paths may be located at intervals over the entire circumference of the introduction port.

In this aspect, a large number of the hydrogen flow paths can be connected to the introduction port. That is, when the number of the hydrogen flow paths is increased, a flow rate of hydrogen gas can be increased, and accordingly, thermal stress caused by a temperature difference between a cooling medium and hydrogen gas is likely to be generated. However, since local generation of thermal stress is prevented as described above, it is possible to increase a flow rate of hydrogen gas while preventing an adverse effect due to stress concentration.

(3) The microchannel heat exchanger may include a lead out port for flowing out hydrogen gas passing through the heat exchange region from the high temperature side layer. In this case, the plurality of hydrogen flow paths may extend from the introduction port to the lead out port without branching.

In this aspect, since the hydrogen flow path is configured not to branch, local generation of stress can be prevented over the entire hydrogen flow path. Therefore, in a case where the microchannel heat exchanger is used for a purpose where thermal stress or stress caused by internal pressure is likely to occur, it is possible to reduce influence on durability of the high temperature side layer or the cooling side layer.

(4) The microchannel heat exchanger may include an introduction path that is formed so as to penetrate the cooling side layer and the high temperature side layer in the direction in which the cooling side layer and the high temperature side layer are placed on each other and configured to allow the hydrogen gas to flow. In this case, the introduction port may be a part of the introduction path located in the high temperature side layer.

In this aspect, hydrogen gas flows through an introduction path penetrating the cooling side layer and the high temperature side layer in a direction in which the cooling side layer and the high temperature side layer are placed on each other, and flows into a plurality of hydrogen flow paths in the high temperature side layer through an introduction port of a portion located on the high temperature side layer in the introduction path.

(5) A medium introduction port for flowing the cooling medium into the plurality of medium flow paths may be formed on the cooling side layer. In this case, the medium introduction port may have a larger area than the introducing port. In this aspect, a flow rate of a cooling medium introduced into the medium flow path may be larger than a flow rate of hydrogen gas introduced into the hydrogen flow path.

(6) The microchannel heat exchanger may be a heat exchanger used as a pre-cooler of a hydrogen station.

In a hydrogen station, supply operation and stop operation of hydrogen gas are repeated depending on presence or absence of a fuel cell vehicle or the like to be charged with hydrogen gas. For this reason, in a pre-cooler, hydrogen gas is repeatedly cooled and stopped. Furthermore, since hydrogen gas having an extremely high pressure (pressure of 10 MPa or more) circulates through a pre-cooler, local generation and release of extremely large stress are repeated due to internal pressure fluctuation and thermal change, which may affect durability of the microchannel heat exchanger. However, since the microchannel heat exchanger used as a pre-cooler is configured to prevent stress from being locally concentrated, it is possible to reduce influence on durability of the microchannel heat exchanger.

As described above, in the microchannel heat exchanger, it is possible to prevent local and intensive generation of thermal stress in a layer having a plurality of flow paths through which a cooling medium or hydrogen gas flows.

This application is based on Japanese Patent application No. 2023-003368 filed in Japan Patent Office on Jan. 12, 2023, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A microchannel heat exchanger for cooling hydrogen gas with a cooling medium, the microchannel heat exchanger comprising:

a cooling side layer formed with a plurality of medium flow paths for flowing the cooling medium;

a high temperature side layer placed on the cooling side layer, the high temperature side layer being formed with a plurality of hydrogen flow paths for flowing the hydrogen gas and an introduction port for flowing the hydrogen gas into the plurality of hydrogen flow paths; and an introduction path that is formed so as to penetrate the cooling side layer and the high temperature side layer in the direction in which the cooling side layer and the high temperature side layer are placed on each other and configured to allow the hydrogen gas to flow, wherein the introduction port has a circular shape or an elliptical shape, an inflow end of each of the plurality of hydrogen flow paths is connected to a peripheral surface of the introduction port, the cooling side layer and the high temperature side layer include a heat exchange region in which the plurality of medium flow paths and the plurality of hydrogen flow paths overlap each other in a direction in which the cooling side layer and the high temperature side layer are placed on each other, the plurality of hydrogen flow paths extend from the inflow end to the heat exchange region without branching, and the introduction port is a part of the introduction path located in the high temperature side layer.

2. The microchannel heat exchanger according to claim 1, wherein the inflow ends of the plurality of hydrogen flow paths are located at intervals over an entire circumference of the introduction port.

3. The microchannel heat exchanger according to claim 1, further comprising a lead out port for flowing out hydrogen gas passing through the heat exchange region from the high temperature side layer, wherein the plurality of hydrogen flow paths extend from the introduction port to the lead out port without branching.

4. The microchannel heat exchanger according to claim 1, wherein a medium introduction port for flowing the cooling medium into the plurality of medium flow paths is formed on the cooling side layer, and the medium introduction port has a larger area than the introduction port.

5. The microchannel heat exchanger according to claim 1, wherein the microchannel heat exchanger is used as a pre-cooler of a hydrogen station.

6. A microchannel heat exchanger for cooling hydrogen gas with a cooling medium, the microchannel heat exchanger comprising:

a cooling side layer formed with a plurality of medium flow paths for flowing the cooling medium; and a high temperature side layer placed on the cooling side layer, the high temperature side layer being formed with a plurality of hydrogen flow paths for flowing the hydrogen gas and an introduction port for flowing the hydrogen gas into the plurality of hydrogen flow paths, wherein the introduction port has a circular shape or an elliptical shape, an inflow end of each of the plurality of hydrogen flow paths is connected to a peripheral surface of the introduction port, the cooling side layer and the high temperature side layer include a heat exchange region in which the plurality of medium flow paths and the plurality of hydrogen flow paths overlap each other in a direction in which the cooling side layer and the high temperature side layer are placed on each other, the plurality of hydrogen flow paths extend from the inflow end to the heat exchange region without branching, and the inflow ends of the plurality of hydrogen flow paths are located at equal intervals over an entire circumference of the introduction port.

7. A microchannel heat exchanger for cooling hydrogen gas with a cooling medium, the microchannel heat exchanger comprising:

a cooling side layer formed with a plurality of medium flow paths for flowing the cooling medium and a medium introduction port for flowing the cooling medium into the plurality of medium flow paths;

a high temperature side layer placed on the cooling side layer, the high temperature side layer being formed with a plurality of hydrogen flow paths for flowing the hydrogen gas and an introduction port for flowing the hydrogen gas into the plurality of hydrogen flow paths, and a second introduction path that is formed so as to penetrate the cooling side layer and the high temperature side layer in the direction in which the cooling side layer and the high temperature side layer are placed on each other and configured to allow the cooling medium to flow, wherein the introduction port has a circular shape or an elliptical shape, an inflow end of each of the plurality of hydrogen flow paths is connected to a peripheral surface of the introduction port, the cooling side layer and the high temperature side layer include a heat exchange region in which the plurality of medium flow paths and the plurality of hydrogen flow paths overlap each other in a direction in which the cooling side layer and the high temperature side layer are placed on each other, the plurality of hydrogen flow paths extend from the inflow end to the heat exchange region without branching, and the medium introduction port is a part of the second introduction path located in the cooling side layer, and has a larger area than the introduction port.

* * * * *